US005182819A

United States Patent [19]

Shaw

[11] Patent Number: 5,182,819

[45] Date of Patent: Feb. 2, 1993

[54] UNIVERSAL COMMODE STOPPER

[76] Inventor: William S. Shaw, 7606 Silvercrest Cir., Austin, Tex. 78757

[21] Appl. No.: 691,863

[22] Filed: Apr. 26, 1991

[51] Int. Cl.[5] ..... E03D 1/35

[52] U.S. Cl. ..... 4/393; 4/403; 4/395

[58] Field of Search ..... 4/392, 393, 395, 403, 4/404, 378, 396, 397, 400

[56] References Cited

U.S. PATENT DOCUMENTS

| | | | |
|---|---|---|---|
| 811,988 | 2/1906 | Winter | 4/400 |
| 1,230,634 | 6/1917 | White | 4/400 |
| 1,304,432 | 5/1919 | Williamson | 4/400 |
| 1,318,989 | 10/1919 | Guider | 4/403 |
| 1,481,563 | 1/1924 | Schier | 4/397 |
| 1,712,605 | 5/1929 | Delany | 4/403 |
| 2,583,999 | 1/1952 | Culver | 4/404 |
| 3,368,224 | 2/1968 | Ament | 4/393 |
| 3,701,169 | 10/1972 | Kamphausen | 4/400 |
| 4,060,858 | 12/1977 | Fabian | 4/400 X |
| 4,240,167 | 12/1980 | Gilliland | 4/396 X |
| 4,698,859 | 10/1987 | Freed | 4/392 X |
| 4,841,579 | 6/1989 | Antunez | 4/393 |
| 4,872,473 | 10/1989 | Agostino | 4/393 X |

FOREIGN PATENT DOCUMENTS

| | | | |
|---|---|---|---|
| 0110797 | 5/1944 | Sweden | 4/395 |
| 0394068 | 11/1965 | Switzerland | 4/392 |

OTHER PUBLICATIONS

The Condensed Chemical Dictionary, Eighth Edition, 1971, pp. 367, 515, 766, 784 and 931, Van Nostrand Reinhold Company.

*Primary Examiner*—Allan N. Shoap
*Assistant Examiner*—John L. Beres
*Attorney, Agent, or Firm*—Penrose Lucas Albright

[57] ABSTRACT

A kit that includes a universal flapper and water saver valve stop for the fluid outlet of sanitary flush tanks utilizing a flat, thin, doughnut shaped gasket mounted on alternate supports, wherein the use of one support allows the doughnut shaped gasket to maintain its relatively flat configuration as in standard flapper valves, and the use of the alternate support stretches the doughnut shaped gasket to form a truncated cone, the dimensions of which closely follow those of standard ball valves, and the support structure for the valve stop includes at least two connecting devices for alternately connecting the valve stop to the different types of connecting assemblies found in standard flush tanks.

14 Claims, 10 Drawing Sheets

UNIVERSAL COMMODE STOPPER

FIELD OF THE INVENTION

This invention relates to closures of the type designed to be received by the water outlets of sanitary flush tanks. More particularly, the invention is directed to a universal flapper valve which is provided in a kit and designed to fit most current flush commodes.

BACKGROUND OF THE INVENTION

Ordinarily, water outlets of most American sanitary flush tanks comprise either a flapper valve of known construction or a tank ball-valve. Both are designed to effect a delayed sealing of the water outlet of the sanitary flush tank in which they are installed. By closing this water outlet, the outflow of water from the tank to the toilet bowl ceases and the tank is allowed to refill to its desired level. Flow of water into the tank is then terminated in a known fashion. Existing valves are generally composed of either vinyl or rubber formed in various shapes.

It has been learned from research that 45% of water use in the average living environment is in the washroom, and a large percentage of that use is through sanitary fixtures and constitutes flush water. Data which has been gathered indicates that 15% to 30% of this total water use is lost due to leaky flapper valves or faulty ball-cocks (fill valves) ball-valves installed in the flush tanks. Such leakage is usually caused either by improper seating of the valve-stop on the water outlet or by deterioration of the sealing material, although there are, of course, other causes. Research has also ascertained that water lost through faulty ball-cocks causes approximately 15% of the total loss, whereas approximately 85% is due to faulty flapper valves. Based on such estimates, the water lost caused by faulty flapper valves alone amounts to 12% to 25% of the total water use in the average American household or business.

Materials used to effect the seal of the ball-valve or flapper valve against the water outlet are of considerable importance. The material selected should be both durable and flexible and should retain its flexibility over long periods of time while it is immersed in water. Generally either rubber or vinyl are currently used for stop valves which are commercially available. However, research suggests that valve stops constructed of such materials begin to leak silently and undetectably to the average homeowner in a surprisingly short period of time.

A vexing problem that faces the consumer who seeks to replace a system previously or originally installed in a flush tank is the wide variety of devices which are commercially available, each having been designed with a specific system in mind. There is an enormous diversity among marketed devices whereby prospective buyers are faced with the unfortunate and undesirable problem of determining the optimal system for their particular flush tanks to be selected from among many varieties of competing systems, any one of which may be unsuitable for their particular flush tanks. There is a need for a stop valve system which has universal or almost universal adaptability to be received by most flush tank systems currently installed in American homes, offices and factories. Moreover, there is a need that such a universal system provide a dependable closure of the flush water outlet and not be such that it commences to leak silently and undetectably shortly after installation.

SUMMARY OF THE INVENTION

The instant invention is essentially a kit having specific parts which permit it to be assembled and used with all or almost all known commercial types of commodes regardless of age. To accomplish this, a donut or ring-shaped seal is used which is received in a peripheral circular slot to provide an essentially flat-shaped seal member in one configuration, and which also can be received in a further circular peripheral slot to assume a conical shape in a different arrangement. An important object of the present invention is to provide a valve-stop system which can be received and installed without undue difficulty in most water tanks found in bathrooms of American homes, offices, businesses and factories, while, at the same time, overcoming the other problems of material deterioration and improper seating.

It has been found that this can be accomplished in the combination disclosed by the use of a relatively thin gasket ring or donut-shaped member composed of silicone RTV. Such gasket ring may be successfully employed as a valve-stop for most currently installed sanitary flush tanks and a support body may be provided which supports the gasket in at least two optional arrangements so as to be a suitable replacement for both flapper valves and ball-valves valve stops which are standard in most flush tanks.

In addition, the plastic molded flapper body has an extremely long life (greater than 15 years) so that only the gasket material will need to be replaced periodically. This is a simple and inexpensive task.

Other objects, adaptabilities and capabilities of the invention will appear and be appreciated by those skilled in the art as the description progresses, of references being had to the accompanying drawings in which:

DESCRIPTION OF THE PREFERRED EMBODIMENTS

Figure 1:
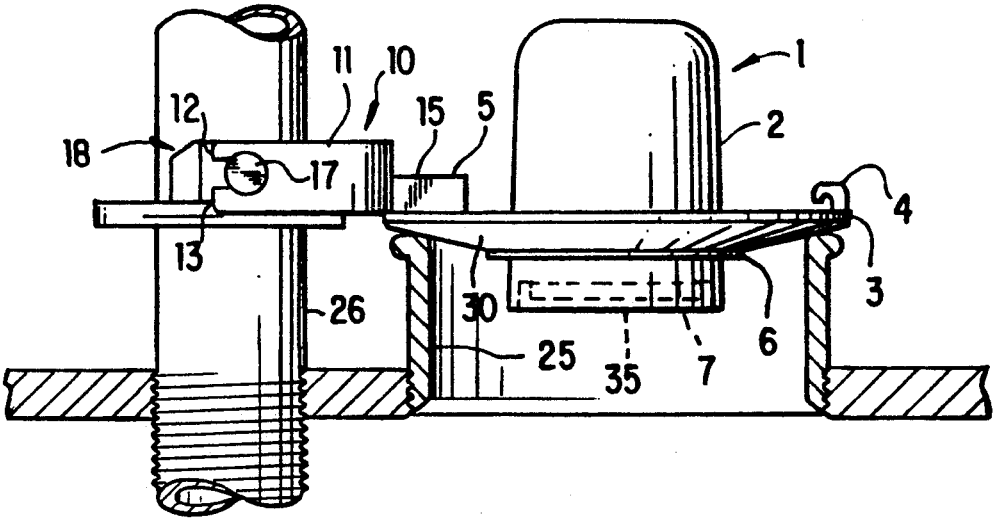
FIG. 1 is a front elevational view of the invention in partial section showing the ring valve in a first arrangement.
Figure 2:
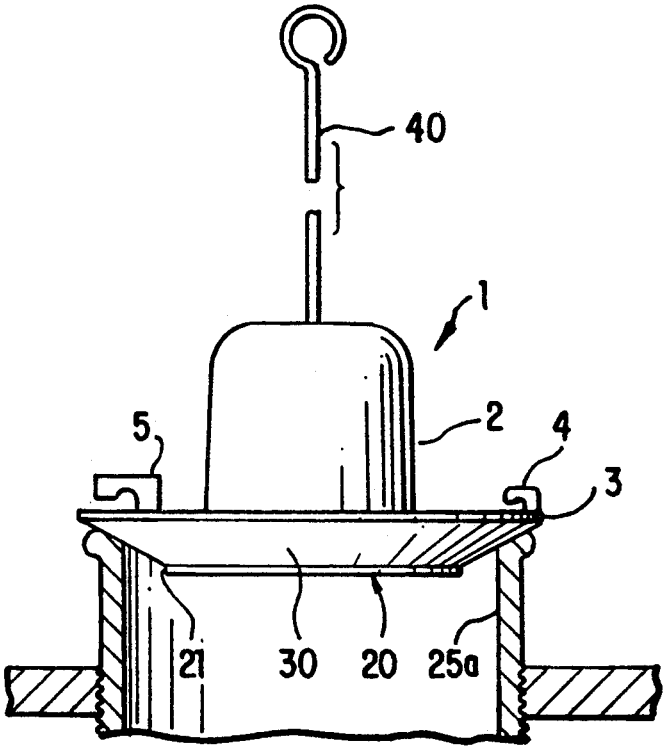
FIG. 2 is a front elevational view and partial section similar to FIG. 1 which shows the ring valve part in a second arrangement.
Figure 3E:
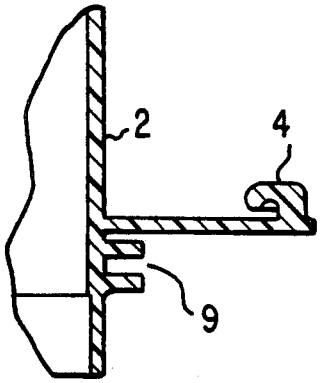
FIG. 3E is a detailed enlarged view of the main outwardly projecting ring and the shorter outwardly extending rings which form a groove for the ring valve member.
Figure 3A:
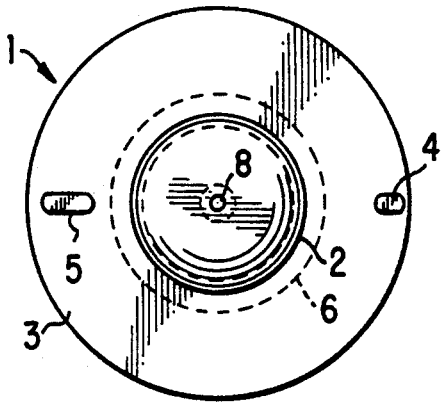
FIG. 3A is a top plan view of the valve support body in accordance with the invention.
Figure 3B:
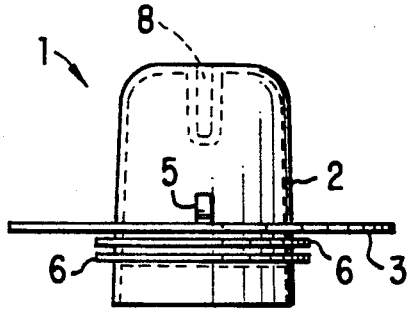
FIG. 3B is a side elevational view of the valve support body shown in FIG. 3A.
Figure 3D:
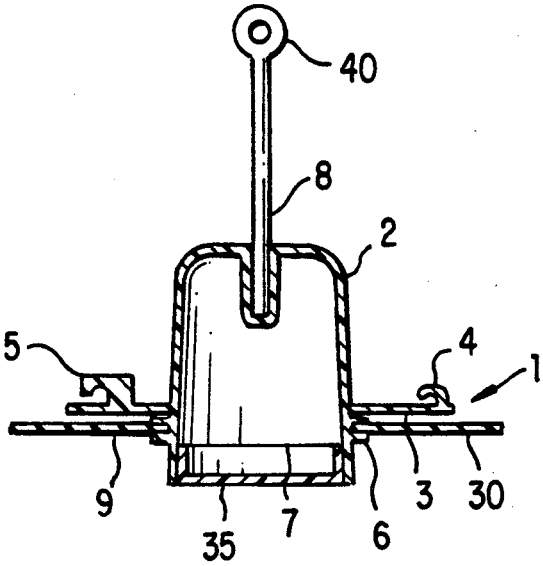
FIG. 3D is a sectional view taken across the center line shown in FIG. 3A.
Figure 3F:
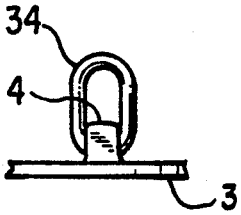
FIG. 3F is a detailed view illustrating how a chain link is snapped on a hook projecting upwardly from the surface of the main ring.
Figure 3C:
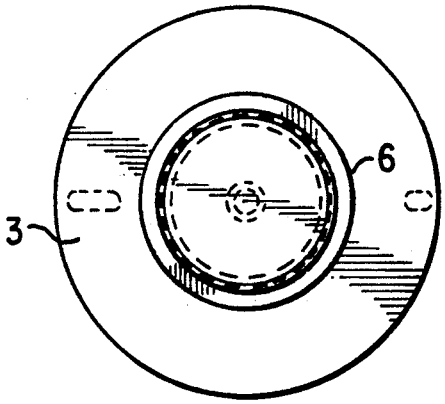
FIG. 3C is a bottom view of the same support body.
Figure 4A:
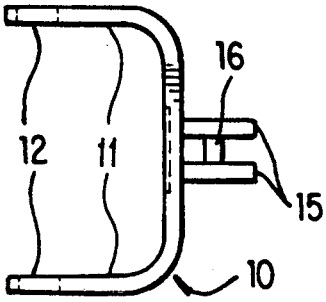
FIG. 4A is a top plan view of a stopper yoke which is utilized to connect to a further hook on the main ring of the valve support body.
Figure 4B:
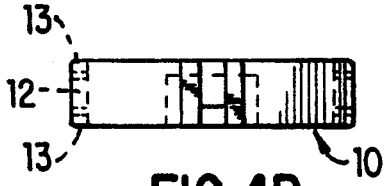
FIG. 4B is a front view of the yoke shown in FIG. 4A.
Figure 4C:
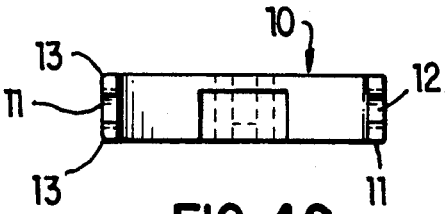
FIG. 4C is a back view of such yoke.
Figure 4D:
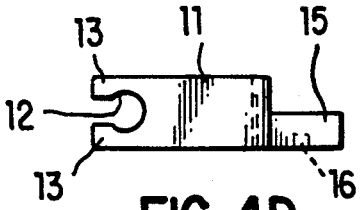
FIG. 4D is a side elevational view of the same yoke.
Figure 4E:
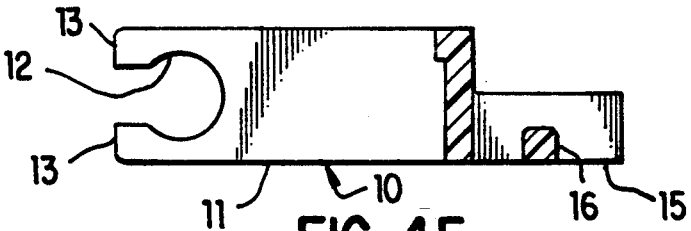
FIG. 4E is an enlarged view in partial section taken on section lines A—A of 4A.
Figure 5A:
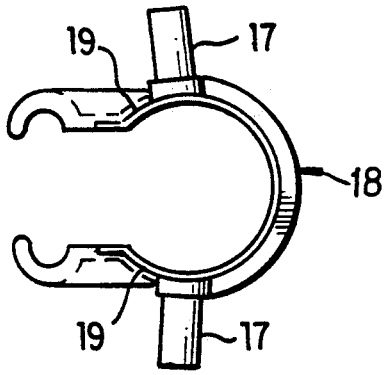
FIG. 5A is a plan view of a hinge collar to which the stopper yoke is connected and which embraces the overflow pipe of the flush tank.
Figure 5B:
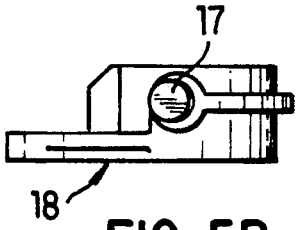
FIG. 5B is a side elevational view of the hinge collar shown in FIG. 5A.
Figure 5C:
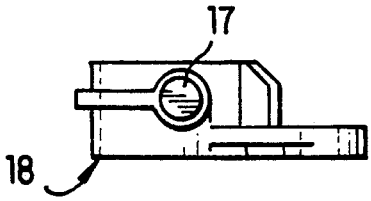
FIG. 5C shows the other side of the hinge collar.
Figure 5D:
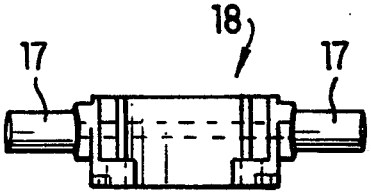
FIG. 5D is a rear view of the hinge collar.
Figure 6A:
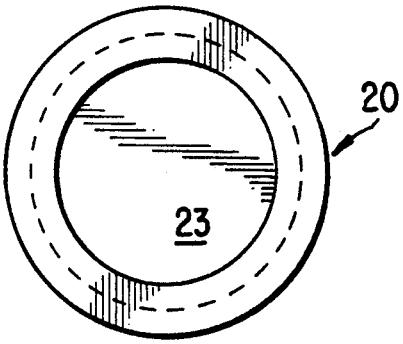
FIG. 6A is a top plan view of a gasket adaptor for the ring valve.
Figure 6B:
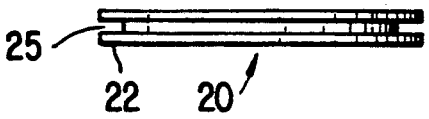
FIG. 6B is a side view of the adaptor shown in FIG. 6A.
Figure 6D:
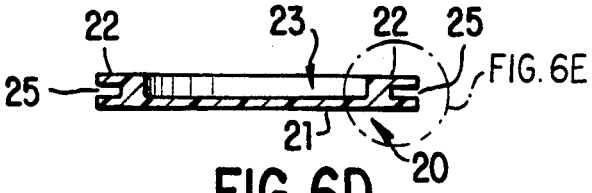
FIG. 6D is a sectional side elevational view of the adaptor through its diameter.
Figure 6E:
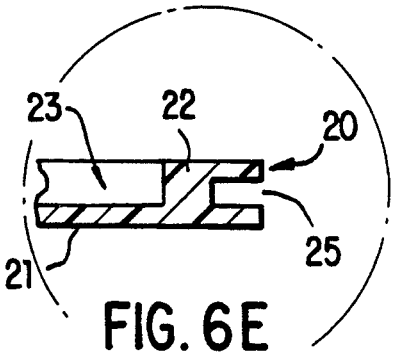
FIG. 6E is an enlarged view of one edge of the adaptor as shown in FIG. 6D.
Figure 6C:
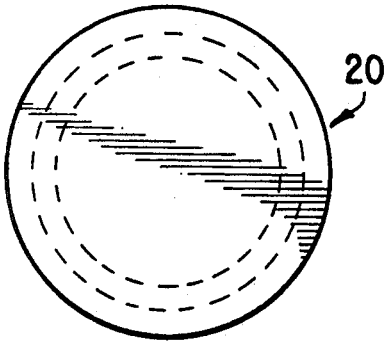
FIG. 6C is a bottom view of the same adaptor.
Figure 7B:
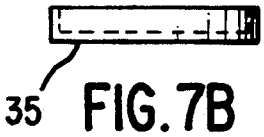
FIG. 7B is a side view of the plug shown in FIG. 7A.
Figure 7A:
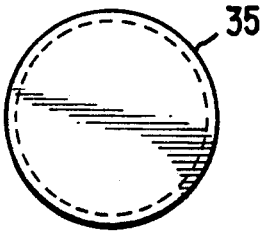
FIG. 7A is a plan view of the bottom plug which is affixed to the bottom of the valve support body.
Figure 7C:
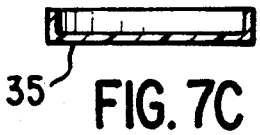
FIG. 7C is a sectional view of the same plug through the diameter thereof.

Referring now to FIGS. 1 and 2, and particularly FIG. 1, the valve support body is referred to generally by reference numeral 1 and comprises a one-piece injected molded body of plastic material, preferably Lexan, a thermoplastic carbonate-lined polymer, which may be either crystal-clear or color coated, depending upon sales and distribution requirements. Body 1 includes an outwardly projecting rib or ring 3 which is generally a flat configuration and is integral and formed so as to be of one piece with the upper section 2 of body 1. Projecting from the upper surface of ring 3 and at diametrically opposite sides thereof are two hook-like projections 4 and 5. Projection 4 is designed to engage an operating chain (not shown) and hook-like projection 5 engages the stopper yoke 10. Situated below ring 3 and projecting outwardly from section 2 and part of the same one-piece construction are two further ribs or rings 6, only the lower ring 6 being shown in FIG. 1. However, as seen in FIG. 3D, rings 6 are spaced apart from each other to define a cavity 9 which encircles section 2. It will be noticed that rings 6 are of a substantially less radial dimension than ring 3. They serve as supports to engage the flat donut-shaped gasket or ring valve 30 in a snug, water-tight relationship between the side walls of ring 6 and within cavity 9. Although gasket 30 may be constructed of any durable, water resistant material, preferably it is silicone RTV.

Although the preferred material for the gasket is RTV, a silicone rubber purchased as a silicone sheeting inasmuch as impurities in water very considerably geographically there are other materials which may be preferable for certain locations. A very good gasket material is available under the trademark "Viton"which is a fluoroelastomer. It is highly resistant to corrosive liquids. A terpolymer elastomer made from ethylene-propylene diene monomer (EPDM) may also be used. The material selected preferably has a hardness factor in the range of 50 to 70 durometers and preferably 60 durometers.

Valve support body 1 with gasket 30 arranged as shown in FIG. 1, when in closed position, engages the water outlet 25 of the flush tank in a water-tight relationship, the gasket 30 as shown in FIG. 1 is securely pressed by the water pressure in the tank against ring 3 and has a shallow frusco-conical shape.

The lower end of section 2 terminates at an opening 7 which snugly and in a water-tight fashion receives plug 35 which is preferably affixed thereto. As shown in FIG. 3D, the upper side of section 2 includes a bore 8 which is threaded and so dimensioned to receive the bottom portion of a standard rod 40 of a type well known for prior art valves in a threaded engagement. Bore 8 is of sufficient depth to ensure that rod 40 and section 2 are firmly secured together when rod 40 is threadably received in bore 8.

The stopper yoke 10 is shown in detail in FIGS. 4A through 4E. It comprises two arms 11 which terminate in snap-clamps 12. A space 14 of semi-circular configuration is defined by two smaller resilient arms 13 which extend towards each other. On the opposite side of yoke 10 are two projecting arms 15 which are joined by an intermediate pivot member 16. These projecting arms 15 engage hook 5 to function as a pivot for yoke 10, allowing a small amount of play between the body 1 and yoke 10. Arms 13 are adapted so that they can snap into either existing, standard fittings for flapper valves such as those which are frequently installed in sanitary flush tanks, or alternatively into pivot extensions 17 of hinge collar 18 which is shown in detail in FIGS. 5A through 5D. Hinge collar 18 is used when either no flapper valve had been previously installed in the sanitary flush tank, or a flapper valve had been previously installed but was found to be dimensionally incompatible with the valves of the instant invention. In the event hinge collar 18 is installed, arms 19 are snapped around the existing overflow tube 26 or a support for same such as the rectangular amount used by Crane commodes. Valve seat 25 is shown as horizontally disposed in FIG. 1. However, it is often tilted at about 15° away from overflow tube 26.

Referring now to FIG. 2 and FIGS. 6A–6E, the adaptor 20 shown therein forms an important aspect of the invention. Adaptor 20 is preferably of one piece construction and comprises a flat, cylindrical body, with one end closed by wall 21. Wall 21 together with a further circular wall 22 define a cylindrical cavity 23. Projecting outwardly from wall 22 are two circular ribs or rings 24 of similar dimensions which together define a circular groove 25. Cavity 23 is of an appropriate size and configuration so that it fits snugly over the opening 7 in the lower part of section 2, thereby closing section 2 and trapping air therein not already trapped by plug 35. When adaptor 20 is so attached to section 2, it will be seen that wall 22 along with rings 24 and groove 25 extend outwardly beyond the radial dimensions of rings 6. Therefore when gasket 30 is fitted in its lower opening onto adaptor 20 between walls 24 and into groove 25, gasket 30 is stretched approximately 18% more than its configuration when received in cavity 9. This stretched arrangement and configuration of gasket 30 assumes the shape of a truncated cone as seen in FIG. 2 which closely matches the contour of existing ball-flappers.

Figure 8D:
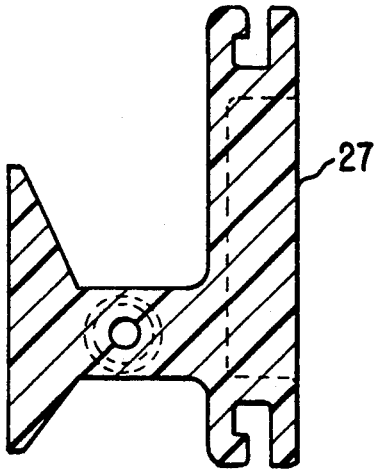
FIG. 8D is a further sectional view taken through the section lines B—B of FIG. 8B.
Figure 8A:
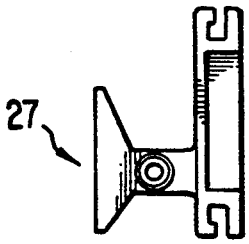
FIG. 8A is a side elevational view of a clip-on axle for American Standard flush commodes.
Figure 8C:
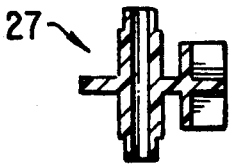
FIG. 8C is a sectional view of the clip-on axle taken through section lines A—A of FIG. 8A.
Figure 8B:
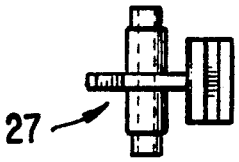
FIG. 8B is a plan view of the clip-on axle shown in FIG. 8A.
Figure 9A:
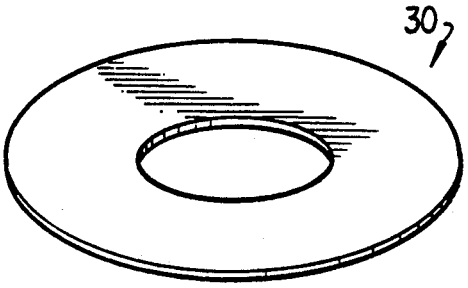
FIGS. 9A through 9G illustrate the parts which are included in a kit in accordance with the invention.
Figure 9B:
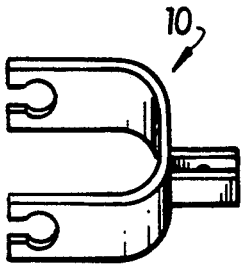
Figure 9C:
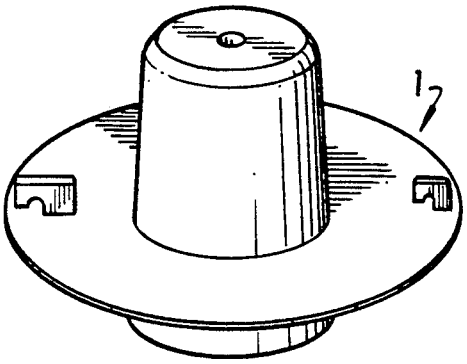
Figure 9D:
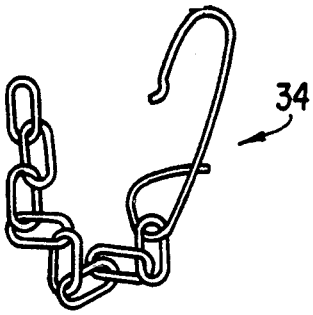
Figure 9E:
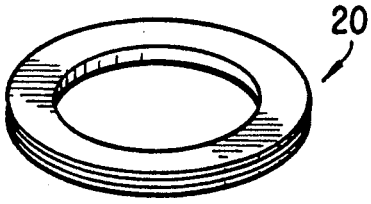
Figure 9F:
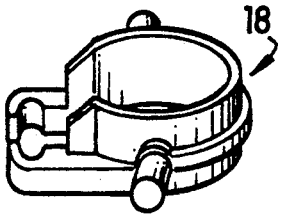
Figure 9G:
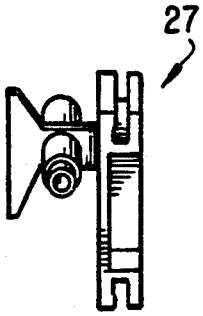

The clip-on axle as shown in FIGS. 8A–8B is designed in particular to adapt the invention for insulation on American Standard flush mechanisms as installed in their toilet tanks.

When a kit containing the parts described above is utilized in a mechanism for tank flushing that uses a regular flapper valve, then the parts used are those shown in FIG. 1. However, when a ball-valve is to be replaced, then the parts used will often conform to those shown in FIG. 2. With American Standard, then the part 27 illustrated in FIGS. 8A–8D is employed together with the valve support body 1, the adaptor 20, and the yoke 10. For replacement of the Crane flapper valve, hinge collar 18 will also be required. In addition to the parts illustrated and described, the kit also includes a chain and a hook for the chain.

Figure 10A:
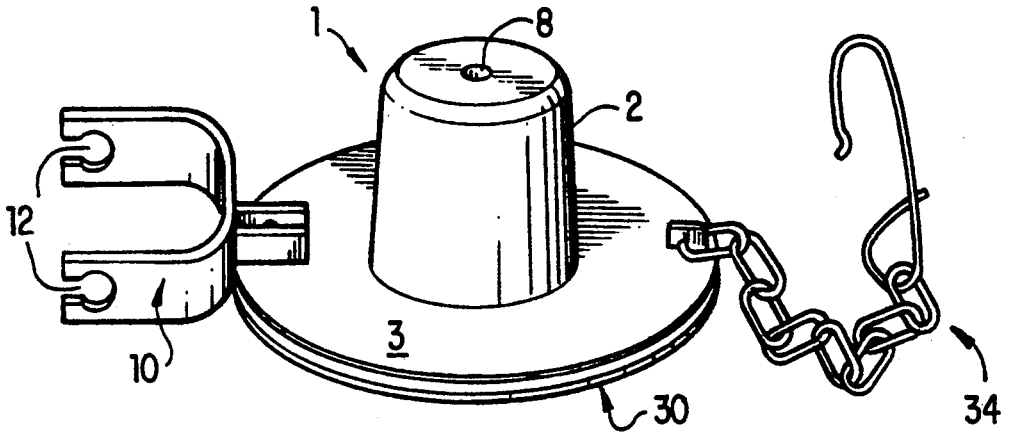
FIG. 10A is a perspective view showing the configuration of the invention in a usual or normal type of installation.
Figure 10B:
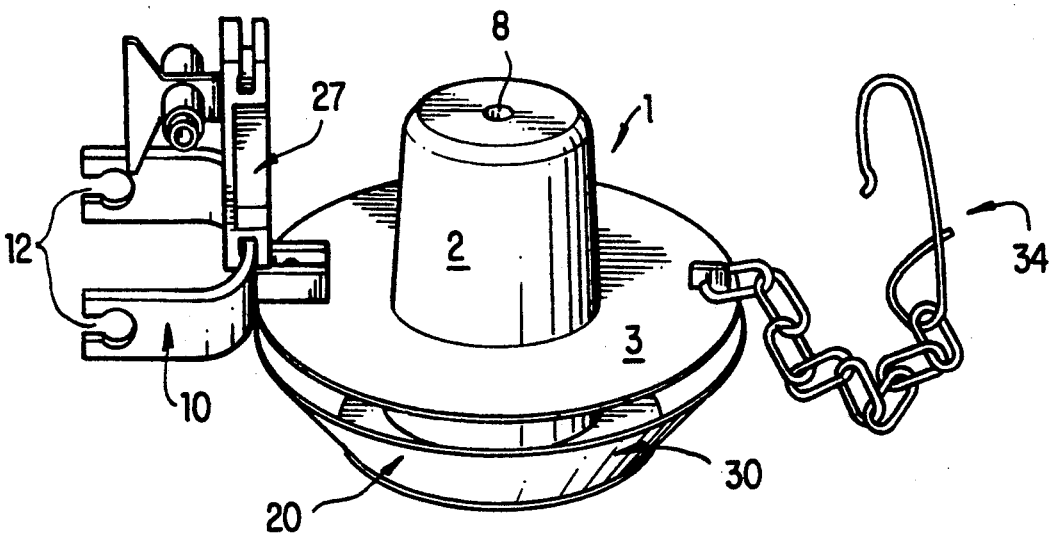
FIG. 10B is a perspective view which illustrates the parts as assembled for an American Standard flush commode.

The parts ordinarily provided in a kit in accordance with the invention are illustrated by FIGS. 9A, 9B, 9C, 9D, 9E, 9F and 9G, which are respectively, gasket 30, yoke 10, body 1, hook and chain 34, adaptor 20, clamp 18 and axle 27. FIGS. 10A, 10B, 10C, 10D and 10E illustrate various assemblies which can be constructed from the kit, thus 10A shows a normal or usual configuration which is frequently found in flush tanks and includes gasket 20, yoke 10, body I, and the hook and chain combination 34. For many American Standard tanks, the assembly shown in FIG. 10B is used which includes, yoke 10, axle 27, body 1, hook and chain combination 34, adaptor 20, and gasket 30.

Figure 10C:
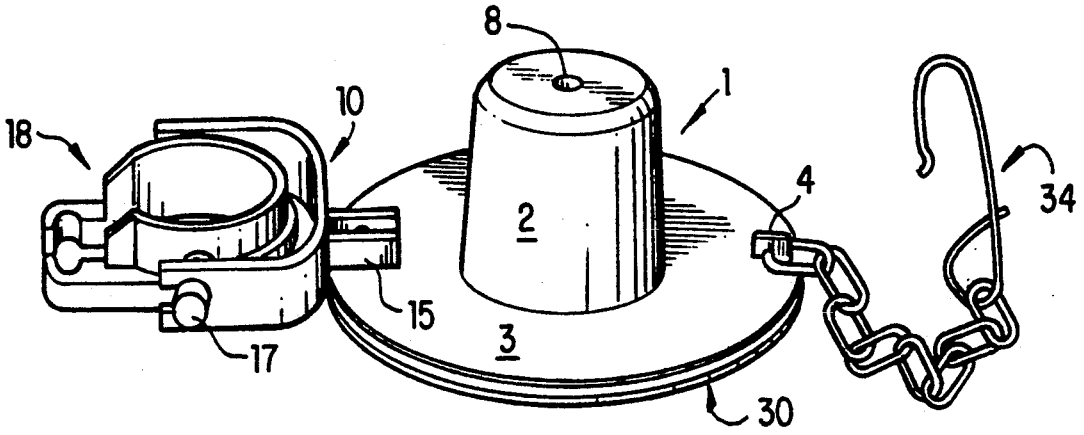
FIG. 10C is a figure similar to FIGS. 10A and 10B for installations of Crane and other manufacturers.

An assembly for Crane flush tanks and others is shown in FIG. 10C, which includes a clamp 18, yoke 10, body 1, together with gasket 30, and the hook and chain combination 34.

Figure 10D:
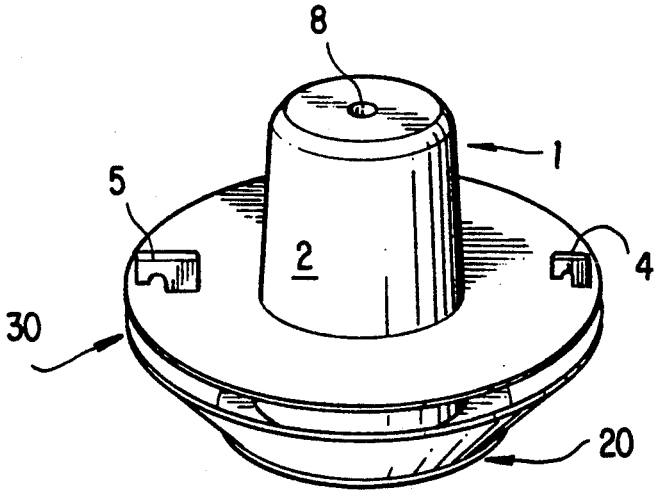
FIG. 10D is a similar perspective assembly view wherein a rod rather than a chain and hook are used such as for Eljer and other types of flush commodes.

In FIG. 10D for Elger flush tanks and others, there is a body 10, which includes a bore 8 for receiving a rod 40 (not shown in FIG. 10D), an adaptor 20 and gasket 30.

Figure 10E:
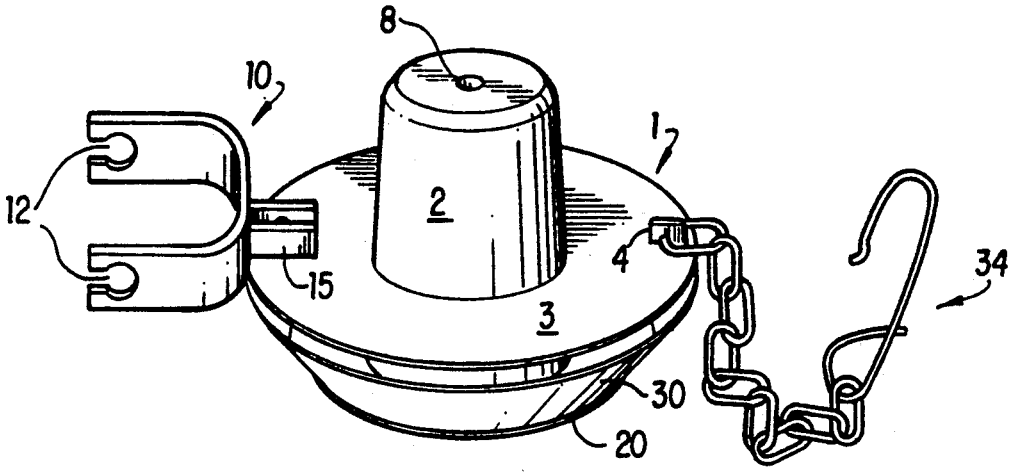
FIG. 10E is a similar perspective assembled view of the parts required for installation in a further type of flush commode.

The parts for a further type of flush tank are shown in FIG. 10E and are the same as for the normal configuration except that there is an adaptor 20 to assume the frusco-conical shape.

In each of FIGS. 10A through 10E, the gasket 30 is illustrated somewhat lower than its actual position relative to body 1.

Figure 11:
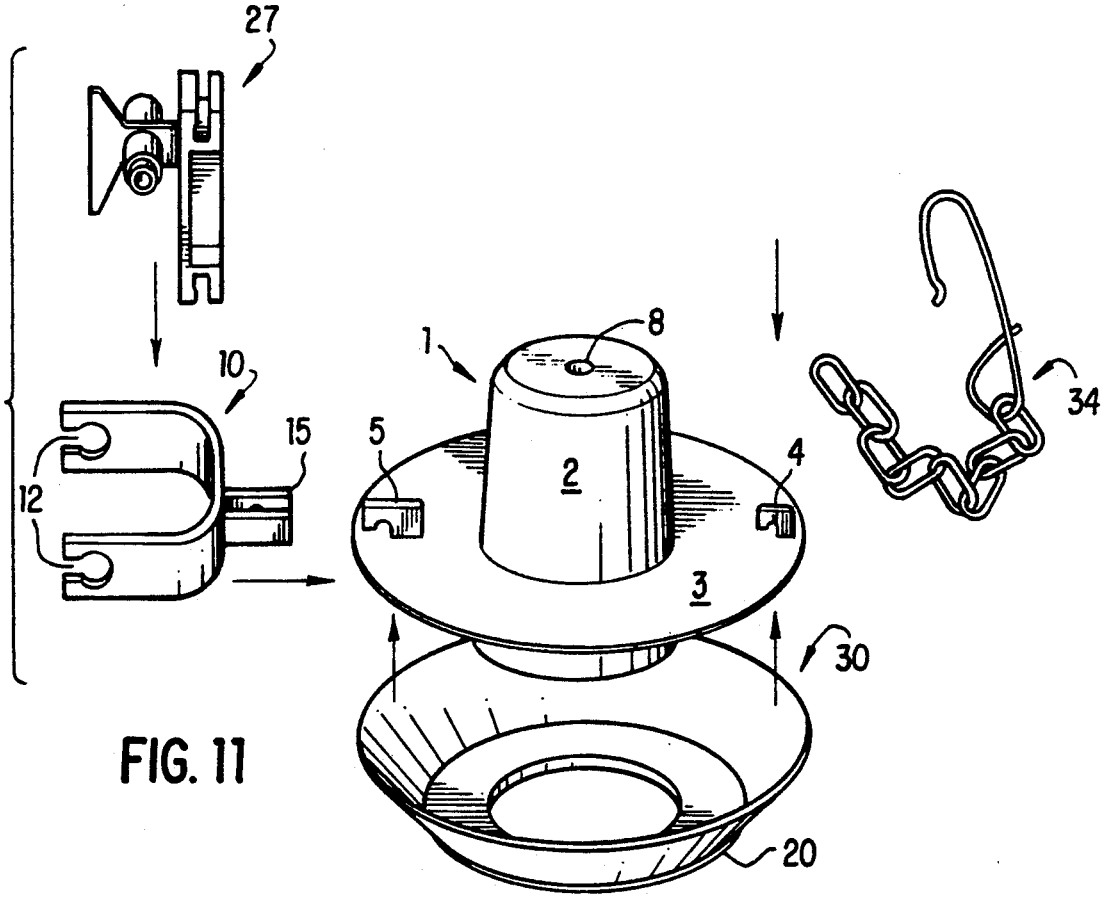
FIG. 11 is a perspective exploded view illustrating the assembly of the various components for an American Standard installation.

An assembly drawing, with the parts exploded, is shown in FIG. 11, which includes the yoke 10, axle 27, body 1, hook and chain combination 34, adaptor 20 and gasket 30.

From the foregoing, it will be appreciated by those skilled in the art that with the seven parts provided as shown in FIGS. 9A through 9G, the kit can be used in a simple manner to construct an advantageous replacement valve part for almost all commercial flush tanks which are normally found in this country.

In addition, suitable directions are, of course, included with the kit for the various adaptations thereof.

It is to be understood that although the preferred embodiments of the invention have been disclosed herein, it is capable of other adaptations and modifications within the scope of the following claims:

Having disclosed my invention, what I claim as new and to be secured by Letters Patent of the United States is:

1. A valve stop for connecting between the valve actuator assembly and the fluid outlet of a sanitary flush tank comprising a cylindrical hollow body of rigid material, said cylindrical hollow body supporting a gasket at its lower end to effect a seal against said fluid outlet, said cylindrical hollow body further comprising at least one support means for said gasket, and at least two alternative connecting devices disposed on said cylindrical hollow body for connecting said cylindrical hollow body to said valve actuator assembly.

2. A valve stop as claimed in claim 1 wherein said cylindrical hollow body comprises a closed end, and an open end.

3. A valve stop as claimed in claim 2 comprising a plug means for said open end of said cylindrical hollow body.

4. A valve stop as claimed in claim 1 wherein said cylindrical hollow body is constructed as a one-piece injection mold of plastic material.

5. A valve stop as claimed in claim 1 wherein said cylindrical hollow body is constructed of a seamless, rigid, lightweight plastic material.

6. A valve stop as claimed in claim 1 wherein said cylindrical hollow body is constructed of a thermoplastic carbonate-linked polymer.

7. A valve stop as claimed in claim 1 wherein said gasket is constructed as a flat doughnut shape of resilient material.

8. A valve stop as claimed in claim 1 wherein said gasket is constructed of a silicone rubber compound.

9. A valve stop as claimed in claim 1 wherein said gasket comprises an inner, circular opening, the circumference of which is only slightly less than the circumference described by the outer surface of said cylindrical hollow body.

10. A valve stop as claimed in claim 1 wherein said support means comprises a separate cylindrical body, connectable to said cylindrical hollow body, said separate cylindrical body comprising two rings disposed circumferentially of said separate cylindrical body, said rings spaced in an even, parallel fashion one from the other and forming a cavity circumferential of said separate cylindrical body, said cavity being of greater radial dimension than said cylindrical hollow body.

11. A valve stop as claimed in claim 1 wherein said support means comprises a separate cylindrical body, said separate cylindrical body mountable at the lower end of said cylindrical hollow body, said separate cylindrical body comprising an inner cavity having a circumference that matches the circumference described by the outer wall of said cylindrical hollow body.

12. A valve stop as claimed in claim 11 wherein said separate cylindrical body is mounted onto an end of said cylindrical body and is held by frictional means.

13. A valve stop as claimed in claim 11 wherein said separate cylindrical body comprises a support means for said gasket, said gasket having a doughnut shape, said support means describing a circumference greater than the inner circumference of said doughnut shaped gasket and causing said doughnut shaped gasket to form a truncated cone, when attached to said support means.

14. A valve stop as claimed in claim 1 wherein said alternative connecting devices comprise a hook and a hollow threaded chamber.

* * * * *